US005782953A

United States Patent [19]

Shah

[11] Patent Number: 5,782,953

[45] Date of Patent: Jul. 21, 1998

[54] SURFACE HARDENED POWDERED METAL STAINLESS STEEL PARTS

[75] Inventor: Suresh Shah, Sherwood, Ark.

[73] Assignee: Capstan Inland, Hazen, Ark.

[21] Appl. No.: 789,318

[22] Filed: Jan. 23, 1997

[51] Int. Cl.[6] ..... C22C 33/02; B22F 3/12

[52] U.S. Cl. ..... 75/246; 419/29; 419/38; 419/58

[58] Field of Search ..... 75/246; 148/325, 148/327, 328; 419/26, 29, 38, 58; 428/546

[56] References Cited

U.S. PATENT DOCUMENTS

| | | | |
|---|---|---|---|
| 4,366,008 | 12/1982 | Takeuchi et al. | 148/143 |
| 4,724,000 | 2/1988 | Larson et al. | 75/236 |
| 5,080,712 | 1/1992 | James et al. | 75/229 |
| 5,141,554 | 8/1992 | Kijima | 75/246 |
| 5,393,109 | 2/1995 | Gumpel | 285/382.7 |
| 5,417,774 | 5/1995 | Garg et al. | 148/208 |
| 5,427,600 | 6/1995 | Itoh et al. | 75/232 |

*Primary Examiner*—Ngoclan Mai
*Attorney, Agent, or Firm*—Rader, Fishman & Grauer, PLLC

[57] ABSTRACT

Surface hardened ferritic or austenitic stainless steel articles, especially automobile exhaust flanges and Hego bosses, are produced as sintered powder metal parts having a relatively soft ferritic core and a hardened outer surface layer. The method of manufacturing such parts includes compacting a stainless steel powder, followed by sintering, repressing, and surface hardening in an atmosphere containing nitrogen so that the final part density is at least 88% of theoretical density. Such parts have improved strength and are useful as automotive exhaust flanges and Hego bosses.

16 Claims, 2 Drawing Sheets

Fig-4
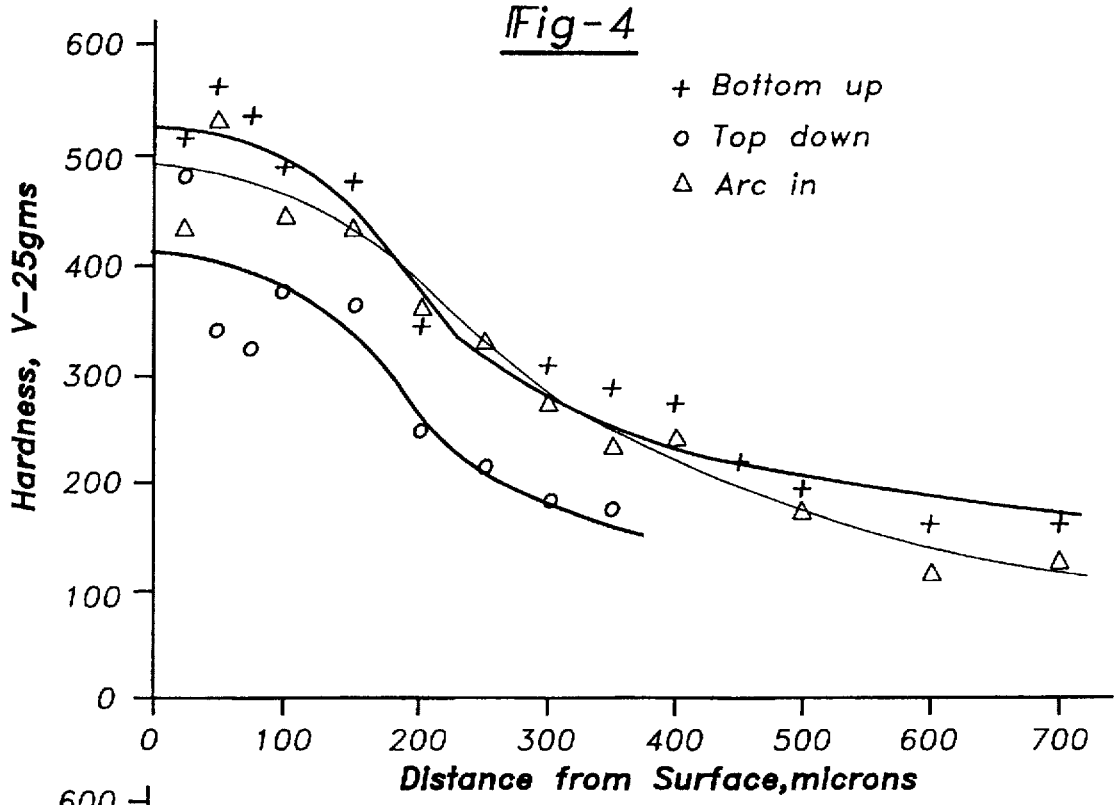
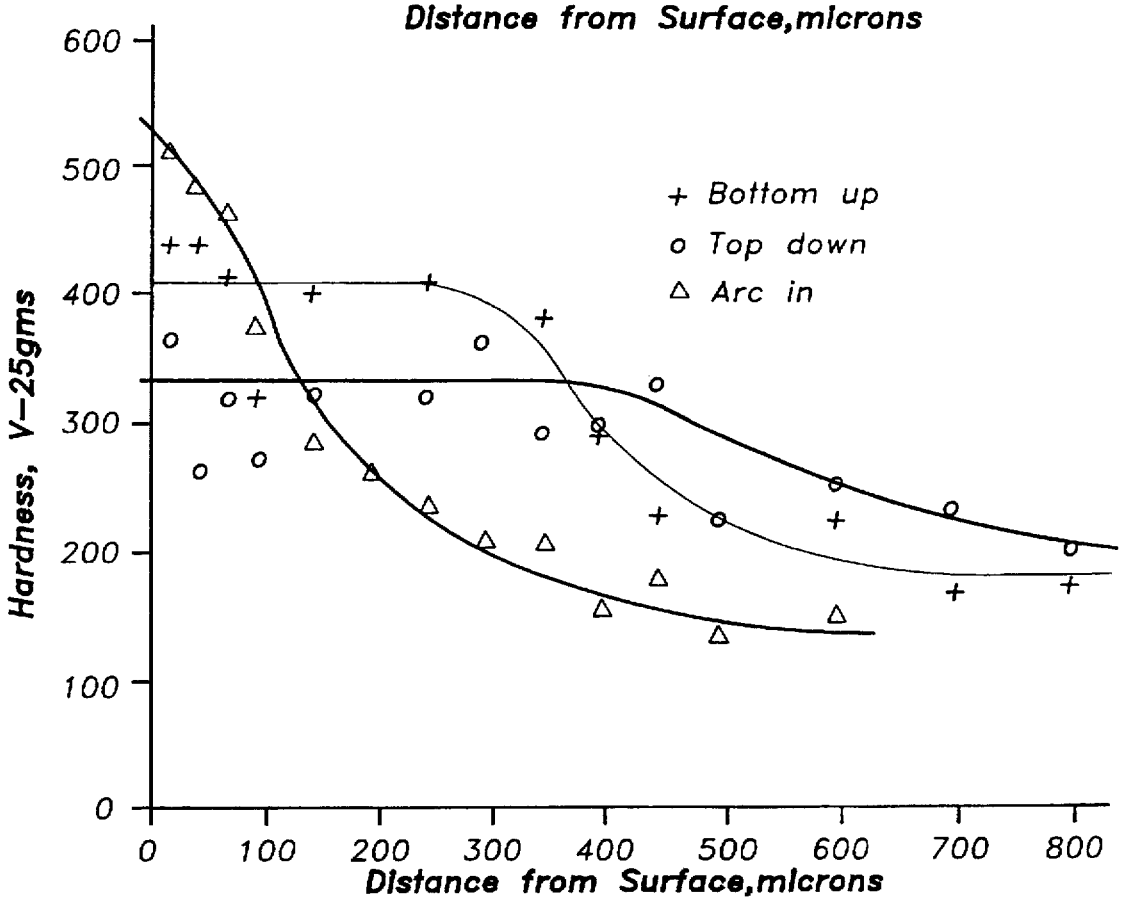
Fig-5

SURFACE HARDENED POWDERED METAL STAINLESS STEEL PARTS

FIELD OF THE INVENTION

The present invention relates broadly to surface hardened powder metallurgy ("P/M") stainless steel parts. More particularly, the invention relates to a P/M stainless steel part having controlled density and porosity to produce a hardened outer surface and a substantially soft, ductile core.

BACKGROUND OF THE INVENTION

Powder metallurgy ("PIM") parts are made by pressing metal powder into a compact, followed by sintering the compact and then performing optional secondary operations. P/M stainless steel parts are commonly sintered in either a hydrogen atmosphere, a vacuum, or a dissociated ammonia atmosphere. When sintered in a dissociated ammonia atmosphere, nitrogen is allowed to permeate the entire cross-section of the part which hardens the part throughout. The part becomes brittle, and toughness and ductility are decreased. Nitrogen increases the strength of the steel, however, the amount of nitrogen that is absorbed, depends on the nitrogen solubility of a given stainless steel. Nitrogen solubility in turn depends on the composition (grade) of steel as well as the sintering conditions such as time and temperature.

P/M steel parts have much greater porosity than wrought steel parts. As a result, some conventional surface hardening processes for wrought parts have not been effectively applied to P/M parts. For example, gas nitriding has not been successful in surface hardening P/M parts. This is because the majority of P/M parts have a significant percentage of interconnected porosity, (i.e. pores that are connected to each other creating passages) that allow the nitriding gas to penetrate too deeply into the P/M part and causing unwanted embrittlement. Therefore, interconnected porosity makes it difficult to control nitrogen addition and has prevented commercial use of gas nitriding for surface hardening P/M stainless steel parts.

The nitrogen addition technique of sintering P/M parts in dissociated ammonia is distinctly different from the gas nitriding technique used for wrought steels. Gas nitriding of wrought steel is done at temperatures of about 1000° F. for 20 to 48 hours and generates a large number of precipitates of chromium nitride.

By contrast, sintering P/M parts in dissociated ammonia limits the amount of nitrogen addition (based on a particular steel's nitrogen solubility) and the sintering temperature is always much greater than the gas nitriding temperature. In fact, the higher sintering temperature actually prevents or minimizes formation of chromium nitrides.

One specific example of a stainless steel part is an automobile exhaust flange. Important exhaust flange properties include corrosion and oxidation resistance at elevated temperatures. The flange must also be leak tight, i.e. it must prevent exhaust gases from leaking to the atmosphere. Adequate toughness is also important. Wrought stainless steel flanges are presently used and provide adequate corrosion and oxidation resistance as well as adequate toughness and good sealing characteristics.

However, it is not known how to produce a P/M stainless steel exhaust flange that achieves the required flange performance characteristics. It is important to utilize as low a density as practicable because of increased costs associated with achieving higher density. In fact, the increase in cost is quite significant when the density of the part is targeted to be in the 93%–100% of the full theoretical density, because conventional P/M processes are not effective in that range.

SUMMARY OF THE INVENTION

The present invention is directed to a surface hardened powdered metal stainless steel part having a hard, thin outer surface layer and a relatively soft, ductile inner core. The present invention allows one of the critical engineering properties required in a automobile exhaust flange, namely gas leak tightness, to be obtained at a relative density as low as 88% of theoretical density. Such a density level allows parts to be economically manufactured via powder metallurgy.

The hardened outer surface layer is conveniently obtained after sintering by exposing a sintered stainless steel part, under controlled conditions, to a nitrogen containing atmosphere at elevated temperature. The resulting hardened outer surface layer is either martensitic or nitrogen in solid solution. The unhardened inner core is substantially ferritic.

For example, if low carbon 410L or 409Cb stainless steel powder is utilized, the nitrogen absorbed during surface hardening results in a hardened outer case containing martensite.

In using higher alloyed ferritic stainless steels such as the 430L and 434L, the absorbed nitrogen will not form martensite upon cooling. Instead, it will form a hardened outer surface layer through what is known as solid solution hardening whereby nitrogen is dissolved into the outer surface layer.

Besides enhancing the overall strength of the flange, the hardened outer surface layer is considered effective in maintaining leak tightness by minimizing wear and plastic deformation of the mating flange and exhaust pipe surfaces. Increased wear resistance is especially critical for a curved surface on the hardened flange which forms a seal against a flared exhaust pipe end.

A P/M steel part fabricated according to the present invention provides a leak tight seal and has high wear resistance yet remains ductile for increased life during cyclic loading.

BRIEF DESCRIPTION OF THE DRAWINGS

The features and inventive aspects of the present invention will become more apparent upon reading the following detailed description, claims, and drawings, of which the following is a brief description:

FIG. 4 is a graph of case hardness versus depth for a flange made according to the present invention.

FIG. 5 is a graph of case hardness versus depth for a flange made according to a different embodiment of the present invention.

DETAILED DESCRIPTION OF A PREFERRED EMBODIMENT

Figure 1:
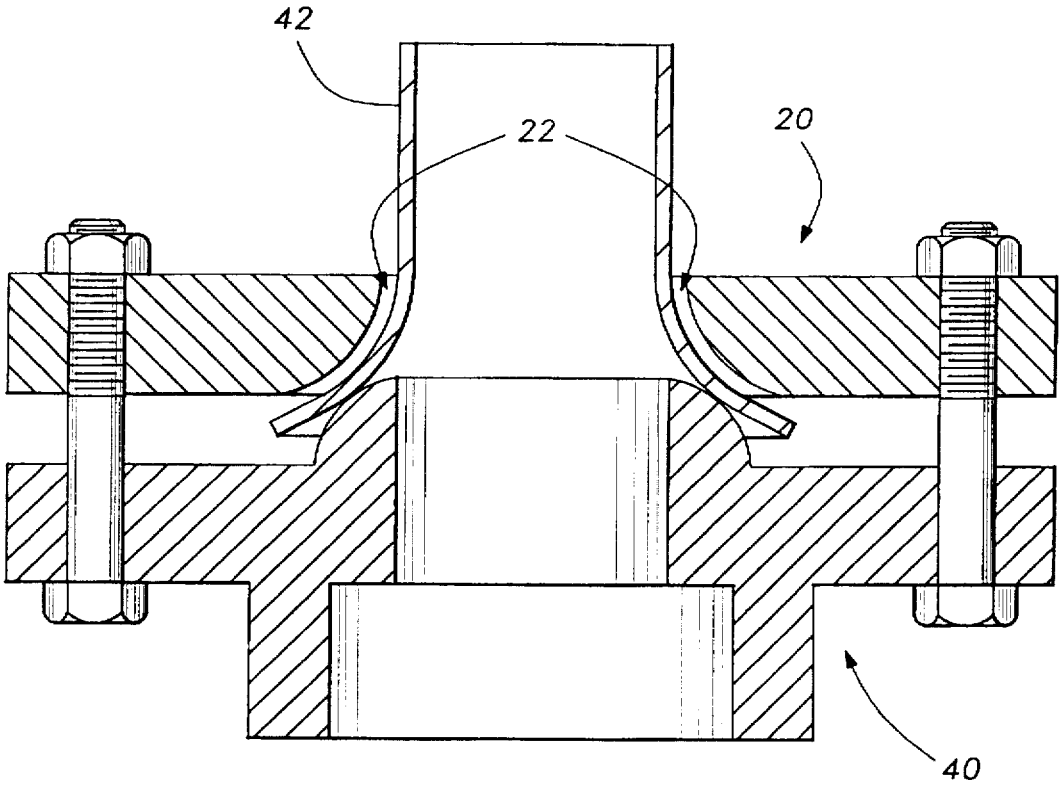
FIG. 1 is a sectional view of a flange for an exhaust pipe coupling made according to the present invention.

FIG. 1 shows a cross-section of a surface hardened, powdered metal exhaust flange 20 for an automotive exhaust coupling made from stainless steel powder according to the present invention. Exhaust flange 20 is shown connected to an exhaust manifold 40. Flange 20 accepts an exhaust pipe 42 which passes through central opening 22 and is fastened to an exhaust manifold 40 using bolts. Flange 20 provides a clamping load which sandwiches and retains the exhaust pipe 42 in a leak tight joint between flange 20 and the corresponding exhaust manifold 40.

In manufacturing flange 20, a series of powdered metal processing steps are employed. First, a stainless steel powder having low carbon content is compacted using approximately 40–60 tons per square inch ("tsi") of pressure. Next, the low carbon stainless steel green compact is sintered in an environment that lacks nitrogen, typically a hydrogen environment or a vacuum. Also, there is no additional carbon present during sintering, as would be the case if graphite were added during compacting. The purposeful avoidance of adding either nitrogen or carbon during sintering helps keep the sintered compact relatively soft by preserving the ferritic microstructure of the stainless steel. If carbon or nitrogen were present, there would be hardening of the compact during sintering. Hardening during sintering is undesirable because flange 20 would become brittle throughout its cross-section and lose ductility.

The sintered compact has an increased density and also has a low percentage of interconnected porosity, i.e. pores that are connected which provide passages for diffusion of nitrogen deeper into the core. The percentage of interconnected porosity is approximately 0.2% to 2.0% or more of total porosity.

After sintering, a repressing operation is optionally but preferably performed to increase the density of the flange and ensure dimensional accuracy. The repressing operation is preferably performed at approximately 40–60 tsi to create a desired density level that will allow sufficient absorption of nitrogen during the surface hardening step. Repressing converts the interconnected pores into interconnected microcracks throughout the part. During nitriding, nitrogen molecules diffuse along the microcracks, but the rate of diffusion is much slower than it would be for interconnected porosity. Simultaneously, with the inter-diffusion of nitrogen into the surface of the part, the healing (bonding of adjacent surfaces) of microcracks takes place which prevents further inter-diffusion of nitrogen into the core. Thus, a properly controlled process produces a nitrogen rich surface layer that is very hard, while the core is left nitrogen free, soft and ductile. If the amount of interconnected porosity is too low prior to repressing, a network of interconnected microcracks is not formed and little surface hardening takes place. In this case, the material behaves similar to wrought steel. Similarly, if the network of interconnected pores is not substantially converted into a network of microcracks, the rate of diffusion of nitrogen will be too rapid, leading to nitridation of the core, as would be expected of a conventional P/M part. Therefore, the formation of microcrack network is desirable for controlling the depth of nitrogen penetration and the depth of the hardened surface layer.

After repressing, flange 20 is surface hardened in an atmosphere containing nitrogen. Examples of surface hardening atmospheres include, but are not limited to, mixtures of nitrogen gas and hydrogen gas in varying proportions or dissociated ammonia. There are many variables to control for ensuring that surface hardening achieves the desired result of a hard outer surface having a desired depth and a relatively soft, ferritic inner core. The surface hardening variables include: time, temperature, density of the part, amount of nitrogen in the atmosphere, percent of interconnected porosity, type of microcrack network formed, and nitrogen solubility level of the selected steel powder.

According to the present invention a P/M stainless steel part can be surface hardened effectively by controlling each of the above variables during each stage of processing. Specifically, the density at each step is critically controlled to ensure a final density just before surface hardening of approximately 88% to 92% of theoretical density. To achieve the final density, it is also necessary to control density at initial compacting and during sintering. At initial compacting, density is in a range of approximately 77% to 82% of theoretical density. Density after repressing is increased by closing the pores between particles including closing some open pores which would otherwise allow nitrogen to penetrate deeper into the part. Preferably, the final density just before surface hardening is 90% to 92% of theoretical density to achieve very reliable surface hardening results.

The percent of interconnected porosity is also closely monitored. Preferably the percent of interconnected porosity is approximately 0.2% to 2.0% of total porosity after repressing which limits the number of open pores available for nitrogen to penetrate deep into the cross-section.

Microcrack formation is controlled at the repressing stage. The amount of pressure during repressing and the ductility of the part after sintering will dictate the degree of microcrack formation and allow nitrogen ingress to a desired depth.

In addition, during the step of surface hardening, several closely related factors combine to determine the degree of nitrogen diffusion into the part. First, the time of exposure is used to control nitrogen absorption. The longer the time that flange 20 is exposed, the greater the diffusion. Exposure times preferably range from one half hour to one hour. Second, the concentration of nitrogen in the atmosphere is selected so as to increase or decrease nitrogen diffusion into flange 20. For example, a 10%–25% nitrogen and 75%–90% hydrogen atmosphere can be used. Third, temperature is controlled because both solubility and nitrogen diffusion rate are directly related to temperature. If temperatures are too low during hardening, excessive amounts of chromium nitrides will precipitate. If temperatures are high, treatment time must be reduced to prevent excessive absorption of nitrogen. Surface hardening temperatures of the present invention are preferably 1600° F. to 2200° F. (871° C. to 1204° C.) which is below sintering temperatures which are preferably 2200° F. to 2400° F. (1204° C. to 1316° C. ).

The following five examples illustrate some of the ways the present invention can be practiced. They are not exhaustive and are not intended to limit the scope of the invention.

EXAMPLE I

A flange 20 was produced using a low carbon, ferritic 410L stainless steel powder. A -100 mesh 410L powder was cold compacted at room temperature under a pressure of 40 tsi to a green density of 6.40 g/cm$^3$, followed by sintering in a hydrogen atmosphere at 2300° F. (1260° C. ) for 45 minutes increasing the density to 6.95 g/cm$^3$. The sintered flange 20 was then repressed to a density of 7.21 g/cm$^3$, following which it was surface hardened. Surface hardening was carried out by heating flange 20 in an atmosphere of 15% nitrogen and 85% hydrogen for 45 minutes at 2000° F. (1093° C. ). Flange 20 was subsequently tested for 20 hours at 1000° F. (540° C. ) in air under a specified load and vibration. The flange 20 showed no leakage and therefore passed the test.

Figure 2:
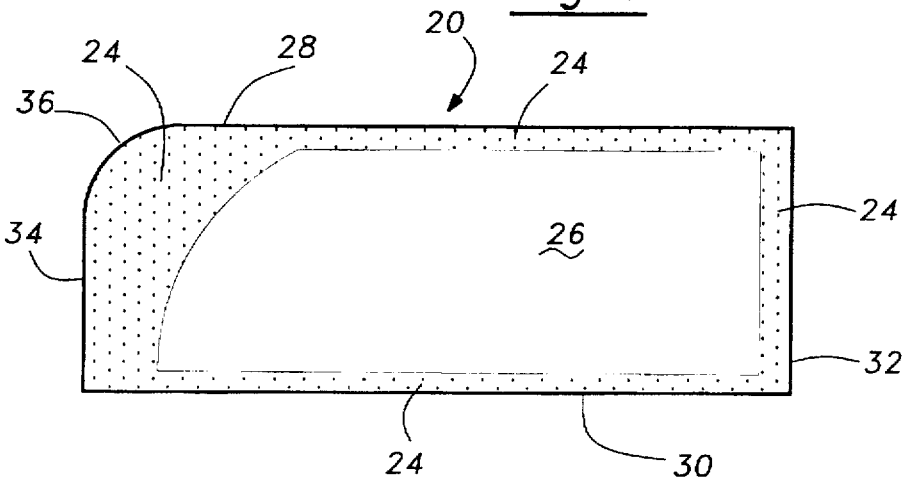
FIG. 2 is a profile of surface hardening depth in a portion of a flange.

As seen in FIG. 2, the microstructure of flange 20 shows a hard, thin outer surface layer 24 that is predominantly martensitic while the core 26 is soft and substantially ferritic. This partial view of flange 20 shows a top surface 28, a bottom surface 30, outer edge 32 and inner edge 34. Inner edge 34 defines central opening 22 which accepts an exhaust pipe. Inner edge 34 also has a corner radius or arc 36. The greater case depth near corner radius or arc 36 is due to a somewhat lower density in that region.

Figure 3:
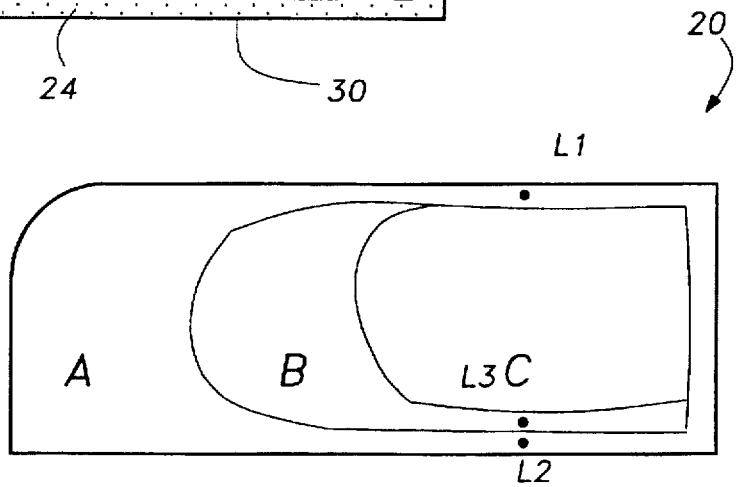
FIG. 3 illustrates thicknesses of a hardened surface layer according to the present invention.

FIG. 3 shows the thickness of hardened surface layer 24 in a flange 20 produced according to Example I. Regions labeled A, B, and C have different microstructures. In core region C, there is predominantly soft ferrite having only 0–5% martensite. Intermediate region B has 30–50% martensite and outer region A has over 90% martensite. Case depths at locations L1, L2 and L3 are also different. At L1, the case depth near top surface 28, is 0.02–0.03 mm having over 80% martensite. L2, near bottom surface 30, had a case depth of 0.05 mm and over 80% martensite. While L3, located interior of L2, had a case depth of 0.05 mm and 30–80% martensite.

Next, FIG. 4 shows a plot of hardness versus distance from respective surfaces 28,30,32,34 at various locations of the cross-section of a flange 20 produced according to Example I.

EXAMPLE II

In this example, a flange 20 was also produced using a low carbon, ferritic 410L stainless steel powder. A-100 mesh 410L powder was cold compacted at room temperature under a pressure of 40 tsi to a green density of 6.40 g/cm$^3$, followed by sintering in a hydrogen atmosphere at 2300° F. (1260° C.) for 45 minutes which increased the density to 6.95 gl cm$^3$. The sintered flange 20 was then repressed to a density of 7.21 g/cm$^3$, following which it was surface hardened. Surface hardening was carried out by heating flange 20 in an atmosphere of 10% nitrogen and 90% hydrogen for 30 minutes at 2100° F. (1149° C. ). Flange 20 was subsequently tested in the same manner as Example I. Flange 20 of Example II also showed no leakage and therefore passed the test.

FIGS. 5 shows a plot of hardness versus distance from respective surfaces 28,30,32,34 at various locations of the cross-section of a flange 20 produced according to Example II.

EXAMPLE III

In this example, a 304L austenitic stainless steel was processed in the same manner as in Example I above. However, in this example, the nitrogen addition in the surface layer 24 did not produce a martensitic case because of the austenitic structure of 304L steel, (410L powder is ferritic at low carbon levels).

Instead, the dissolved nitrogen produces what is known as solid solution hardening. In other words, outer surface layer 24 is a solid solution that is supersaturated with nitrogen. While the hardness and strength increases achieved here are less than those of Example 1, the enhancement of mechanical and other properties will still be useful in automotive flanges, Hego bosses, and other applications.

EXAMPLE IV

A 434L ferritic stainless steel powder was compacted at 50 tsi to a green density of 6.50 g/cm$^3$. The compact was vacuum sintered at 2450° F. for 30 minutes to a density of 7.10 g/cm$^3$. The repressed part (density 7.25 g/cm$^3$) was surface hardened for 20 minutes at 2000° F. (1095° C. ) in an atmosphere that was 80% hydrogen and 20% nitrogen.

As in Example III, there was a hardened surface layer due to the absorption and solution of nitrogen which formed a solution hardened surface. No martensite was formed.

EXAMPLE V

A 409Cb ferritic stainless steel powder was compacted at 45 tsi to a green density of 6.48 g/cm$^3$. The green compact was sintered for 60 minutes in a hydrogen atmosphere at 2200° F. (12040° C. ). The sintered density of flange 20 was 6.92 g/cm$^3$. The sintered flange 20 was then repressed at 40 tsi to a density of 7.15 g/cm$^3$. Surface hardening was accomplished by heating the repressed part in dissociated ammonia (75% H2; 25% N2) at 2200° F. (1204° C. ) for 20 minutes. The part had a hardened surface containing martensite.

The above examples illustrate that the present invention can utilize many different types and grades of stainless steel. The low carbon 410L powder in Example I is actually ferritic, however, in wrought form, 410 is usually designated as martensitic. Other ferritic stainless steel powders such as 434L and 409Cb are illustrated, but other ferritic powder materials are within the scope of the present invention. As evidenced by Examples I,II, IV and V, the base powder can be ferritic but the resulting surface hardening can vary between a martensitic case or a solid solution hardened case.

Austenitic stainless steels are also within the scope of the present invention. Example III used a 304L powder, however other austenitic powdered material could be used. For austenitic materials, the resulting case is solid solution hardened.

The disclosed embodiments and examples are provided to illustrate the present invention. However, they are not meant to limit the scope and spirit of the present invention. Therefore, the present invention should be limited only by the appended claims.

What is claimed is:

1. A surface hardened, sintered powder metal part comprising:

a body formed into a shape of a part using metal powder, said body being sintered and surface hardened;

said body further comprising an outer surface layer and an inner core;

said inner core having a relatively soft, substantially ferritic or austenitic microstructure; and said outer surface layer having a substantially hardened microstructure.

2. The sintered powder metal part of claim 1, wherein said part has a density of approximately 88%–92% of theoretical density.

3. The sintered powder metal part of claim 1, wherein said outer surface layer is substantially martensitic.

4. The sintered powder metal part of claim 3, wherein said metal powder is stainless steel.

5. The sintered powder metal part of claim 1, wherein said outer surface layer comprises a solid solution supersaturated with nitrogen.

6. The sintered powder metal part of claim 5, wherein said metal powder is stainless steel.

7. The sintered powder metal part of claim 6, wherein said part is a flange capable of use in an exhaust coupling.

8. The sintered powder metal part of claim 1, wherein said part has a percentage of interconnected porosity in the range of approximately 0.2%–2.0% of total porosity.

9. A method of making the powder metal part of claim 1 comprising:

forming said body using stainless steel powder wherein said body is pressed to a first density;

sintering said body at a selected temperature to increase said first density to a second density of approximately 88% to 92% of theoretical density and forming interconnected porosity in an amount of approximately 0.2% to 2.0% of total porosity;

repressing said body to selectively convert at least a portion of said interconnected porosity to microcracks which facilitate surface hardening and help control depth of a surface hardened layer; and surface hardening said body in a selected atmosphere.

10. A method of making a powdered metal part comprising:

forming a green compact using stainless steel powder wherein said green compact is pressed to a first density;

sintering said green compact in a nitrogen-free atmosphere at a selected temperature to increase said first density to a second density and forming a predetermined amount of interconnected porosity;

repressing said compact to selectively convert at least a portion of said interconnected porosity to microcracks which facilitate surface hardening and help control depth of a surface hardened layer; and surface hardening said compact in a selected atmosphere.

11. The method of claim 10 wherein said first density is in a range of approximately 77% to 82% of theoretical density.

12. The method of claim 10, wherein said second density is in a range of approximately 88% to 92% of theoretical density.

13. The method of claim 10, wherein said amount of interconnected porosity is in a range of approximately 0.2% to 2.0% of total porosity.

14. The method of claim 10, wherein said sintering temperature is in a range of approximately 2000° F. to 2400° F.

15. The method of claim 10, wherein said atmosphere is made up of approximately 10% to 25% nitrogen and approximately 75% to 90% hydrogen.

16. A method of making a powdered metal part comprising:

forming a green compact using stainless steel powder wherein said green compact is pressed to a first density of at least approximately 77% of theoretical density;

sintering said green compact at approximately 2000° F. to 2400° F. to increase said first density to a second density of at least approximately 88% of theoretical density;

repressing said compact to control dimensional tolerances; and surface hardening said compact in an atmosphere containing nitrogen.

* * * * *